US005227021A

United States Patent [19]

Hernesniemi et al.

[11] Patent Number: 5,227,021

[45] Date of Patent: Jul. 13, 1993

[54] METHOD FOR PRODUCING PULP USING MEDIUM CONSISTENCY MIXER FOR DEFIBERIZING PULP

[75] Inventors: Lasse Hernesniemi, Pietarsaari; Pikka Olavi; Rönkönharju, both of Karhul, all of Finland

[73] Assignees: A. Ahlstrom Corporation, Noormarkku; Wisaforest Oy Ab, Pietarsaari, both of Finland

[21] Appl. No.: 871,468

[22] Filed: Apr. 21, 1992

[51] Int. Cl.[5] ..... D21C 3/26

[52] U.S. Cl. ..... 162/17; 162/25; 162/28; 162/57; 162/60

[58] Field of Search ..... 162/17, 18, 25, 28, 162/55, 57, 60

[56] References Cited

U.S. PATENT DOCUMENTS

| | | | |
|---|---|---|---|
| 4,002,528 | 1/1977 | Laakso | 162/19 |
| 4,560,437 | 12/1985 | Kleppe et al. | 162/25 |
| 4,619,736 | 10/1986 | Henricson et al. | 162/28 |
| 4,737,274 | 4/1988 | Jacobsen et al. | 210/413 |
| 4,971,658 | 11/1990 | Henricson et al. | 162/21 |

*Primary Examiner*—W. Gary Jones
*Assistant Examiner*—Dean Tan Nguyen
*Attorney, Agent, or Firm*—Cohen, Pontani, Lieberman, Pavane

[57] ABSTRACT

A method of defiberizing fibrous cellulosic material bound by chemical bonds and physical force comprising treating the fibrous cellulosic material in a treatment apparatus so as to loosen the chemical bonds between the fibers but to leave the bonds caused by physical force essentiall undisburbed to generate treated fiber accumulations and removing a stream of the treated fiber accumulations from said treatment apparatus and defiberting the treated fiber accumulations by subjecting the material to shear forces in the stream, the shear forces being of sufficient strenth to substantiallyl break the physical forces keeping the fibers together and to separate the fibers. The method of which is performed by step (1) introducing the fibrous material in the form of wood chips into a digester and by chemically treating the wood chips in the digester at a pressure and cooking temperature beyond the difiberation point of the fibrous material so as to soften the wood chips and to loosen the fibers; step (2) removing a tream of the treated wood chips from the digester and step (3) by defiberizing the treated wood chips by generating shear forces in the stream, the shear forces being of sufficient strength to substantially separate the fibers and by subjecting the wood chips to the shear forces.

23 Claims, 5 Drawing Sheets

METHOD FOR PRODUCING PULP USING MEDIUM CONSISTENCY MIXER FOR DEFIBERIZING PULP

FIELD OF THE INVENTION

The present application relates to the manufacture of fiber suspensions from pulped recycled paper or cardboard, or pulped broke or from fibers still in chip form discharged from a digester. Specifically, the application relates to fiberizing of fiber accumulations of the type wherein the chemical bonds have already been loosened and the fiberization process thus includes only the breaking of the physical bonds based on physical forces, such as cohesion, between the individual fibers. According to a preferred embodiment, the present application relates to the manufacture of chemical or semi-chemical pulps and, specifically, to the defiberizing of fibrous cellulosic material which has been delignified beyond the defibration point thereof i.e. the lignin present on the fiber surface has been dissolved.

BACKGROUND OF THE INVENTION

Lignin containing fibers such as unbleached chemical and semi-chemical pulps are frequently used for products in which inferior optical and inferior strength characteristics are acceptable. In general, however, the fiber bonding lignin is separated from the cellulose fibers by delignification, that is, the lignin removal resulting in fiber delamination.

Commercial chemical delignification processes for the selected removal of lignin include acid sulfite pulping, soda pulping, alkaline or so-called kraft pulping which has been adopted world wide, the alkaline-sulfite-process basically attempting to combine the technology of the latter two processes, the neutral sulfite semi-chemical (NSSC) pulping process, and finally, more selective methods for removing residual lignin such as during known bleaching processes including hypochlorite solutions, chlorine dioxide with or without the addition of chlorine, and bleaching technologies based on oxygen and ozone.

After the pulping the digested chips maintain their chip form mainly due to the presence of cohesion forces, although the chips have been cooked to or beyond the defibration point, whereby the lignin has been dissolved from between the individual fibers so that chemical bonds between adjacent fibers no longer exist. The fibers remain parallel to each other due to the presence of mechanical bonds, which do not normally break when the digester is discharged. The pulp which is discharged in form of chips from a continuous digester creates severe problems in the later treatments and, in diffusers whose washing efficiency drops drastically if the pulp in chip form is introduced in the diffuser. The same problem, but less severe, is encountered with other types of digesters and washers.

One way to solve the problem is to dilute the digested pulp in the high-heat zone of the continuous digester to such a low consistency that the pressure difference in the discharge of the digester is sufficient for fiberizing the soft chips. This, however, increases the liquid consumption and thus causes higher environmental problems relating to waste waters and chemical recovery.

U.S. Pat. No. 4,002,528 discloses an apparatus for refining digested pulp in which two or more refiners are positioned in series in the blow line of a continuous digester. The washed, digested material is fed directly into the refiners in which undigested knots and shives are ground into small particles with the objective to render unnecessary the conventional screening operations. The major disadvantage of this procedure is that knots, even after they have been refined into small particles still have a kappa number of about 100 and are unbleachable and are thus diminishing the quality of the pulp. Accordingly, refiners cannot be used in the production of pulp having a low kappa number, i.e. high quality pulp. An additional disadvantage results in the fact that the action of one or more rotary grinding disks of the refiner tends to break up and further divide the individual fibers which is mostly undesirable.

U.S. Pat. No. 4,971,658 discloses the extraction of lignin by washing from alkaline pulps at a consistency of 3–30% after pressurized pre-washing at elevated temperature. It is further disclosed that the extraction of lignin is increased and the kappa number of pulp further decreased by fiberizing the digested material after pre-washing and by carrying out the extraction at elevated temperature.

U.S. Pat. No. 4,737,274 discloses a tramp material separator for the effective separation of unwanted contaminants such as metal, gravel, stones, nuts, knots, and inordinately large wood fiber bundles, or the like. The pulp suspension is fluidized by a specially shaped rotating disk comprising teeth-like structures, or pegs, for moving the contaminants outwardly through a separated particles outlet into a storage container. The pulp freed from the contaminant particles passes through an annular opening into an outlet chamber from which it is pumped out from the separator.

It is also known to arrange a so called blow unit in the blow line between the digester and the diffuser. The blow unit is intended to defiberize high lignin content or high yield pulps, but this has never been achieved. Nowadays in practice all the blow units have been removed as inoperable as they only consume energy (about 20 to 30 kW) without accomplishing their expected objective. The volume of the blow unit is about 620 liters, whereby the maximum energy fed in the blow unit is approximately 30/620=0.048 kW/l.

OBJECTS OF THE INVENTION

It is thus an object of the present invention to improve the defibration of cellulosic material in various pulp mill operations such as digesting, the fiberization of recycled fibers or the defibration in broke systems.

It is a further object of the present invention to considerably increase the degree of fiberization before the diffusers so as to improve the driveability, i.e. the operation of atmospheric as well as pressure diffusers, to improve the operation of a pressure diffuser at higher consistency (between about 10 and about 25%) and, at the same time, to considerably improve the operation of an atmospheric diffuser in continuous digesting processes.

It is yet another object of the present invention to decrease the diffusion distance and the tendency of the pulp in the diffuser to cause "channelling", i.e. the formation of channels between insufficiently fiberized pulp particles which results in an undesirable decrease of displacement efficiency of the diffuser. It is still another object of the present invention to increase the degree of fiberization of the pulp entering the screening stage without breaking the knots which, in turn, enables the separate treatment of the knots and the reduction of the shive content of accepted pulp after the screening stage.

It is yet a further object of the present invention to decrease the washing losses of dry solids, e.g. $Na_2SO_4$ or COD (Chemical Oxygen Demand) per ton of pulp which results in alkali savings and a decrease in the amount of required bleaching chemicals and the environmental benefits flowing therefrom.

It is still a further object of the present invention to considerably reduce the reject portion of the pulp thereby improving the operation of knotters, particularly in batch digesting such as RDH (Trademark of Beloit Corporation) and SUPERBATCH (Trademark of Sunds Defibrator).

It is yet another object of the present invention to fiberize the pulp in such a way that only the physical bonds between the fibers are broken i.e. the chemical bonds keeping the knots together as well as the bonds keeping individual fibers together are left essentially undisturbed.

SUMMARY OF THE INVENTION

These and other objects are achieved by the present invention, in its broadest sense, by introducing a fibrous accumulated material into a treatment apparatus in which the fibers are, at least partially, loosened from each other by breaking the chemical bonds between individual fibers and by leaving the bonds effected by physical forces essentially undisturbed; removing a stream of the treated fibrous material from the treatment apparatus; and further defiberizing the treated fiber accumulations by subjecting the material to shear forces within said stream, said shear forces being of sufficient strength to substantially and completely separate said fibers without cleaving or dividing the solid, chemically bonded particles within said stream of fiber accumulations.

For example, if the present invention is performed in connection with the cooking and subsequent defiberizing the fibrous cellulosic material in which the lignin bonds have been loosened i.e. the lignin has been dissolved, the method includes:

a) introducing the fibrous material in form of wood chips into a digester; b) chemically treating the wood chips in the digester at a pressure and a cooking temperature beyond the defiberation point of the fiberous material so as to soften the wood chips and to loosen the chemical bonds between the fibers; c) removing a stream of the treated wood chips from the digester; and d) defiberizing the treated wood chips by generating shear forces in the stream, the shear forces being of sufficient strength to substantially separate the fibers, and by subjecting the wood chips to the shear forces.

The defibration point depends, of course, on the type of wood or wood species, the pH, the temperature, and the alkali charge and is generally defined by the yield or kappa number after disintegration by a standard defibration treatment. In the method of the present invention, the wood chips are treated in the digester to a kappa number of 50 and below and preferably below 40. Examples of pulps having a low kappa number include alkaline pulps such as bleachable hardwood kraft and bleachable softwood kraft having a kappa number of about 8–25 and 10–50, respectively. Preferably, the defiberization step (d) is performed at temperatures from 70° to 185° C. and more preferably below 100° C. The pressure for example, in continuous digesters ranges from about 10 to about 20 atmospheres, and in batch digesters from 3 to 25 atmospheres. As pointed out above, the kappa number of the fibrous material which is the subject of the present invention is below about 50 and preferably below about 40.

In a preferred embodiment, the method of the present invention includes the washing of the fibrous material at washing stages and the performance of an oxygen delignification between the existing washing stages.

BRIEF DESCRIPTION OF THE DRAWINGS

Several preferred embodiments of the present invention are further described in detail below with reference to the accompanying drawings, in which.

DETAILED DESCRIPTION OF THE PRESENTLY PREFERRED EMBODIMENTS

Figure 1:
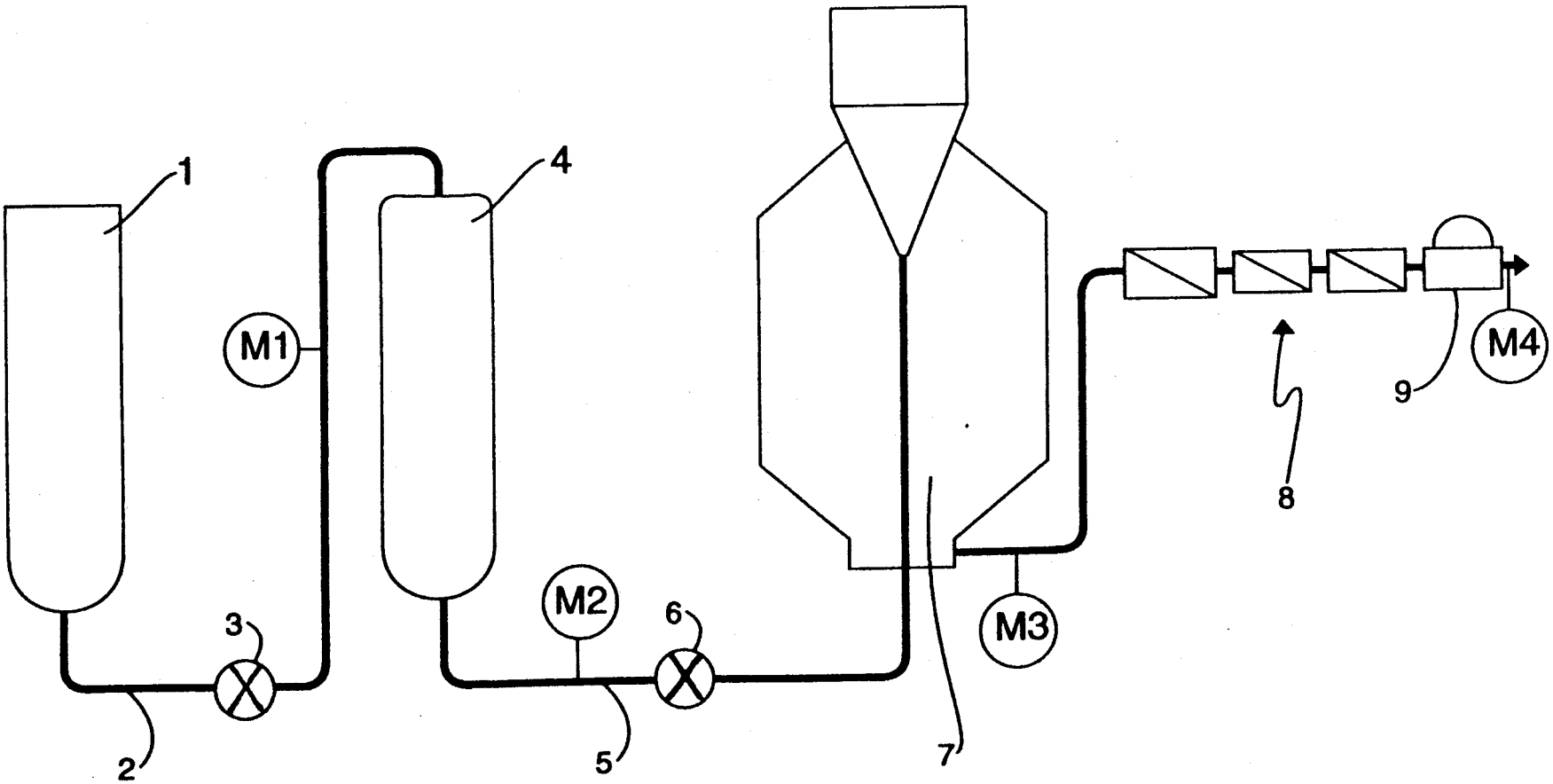
FIG. 1 is a schematic illustration of a fiber line including a continuous digester.

FIG. 1 shows a continuous generally upright digester 1 which is filled at the top (not shown) with wood chips of preferably uniform size and similar wood species. Wood chips having a size distribution according to mill specifications to permit rapid and uniform penetration of the pulping liquor are generally produced by converting debarked logs into wood chips by disk chippers. The chips are thereafter fed to the digester either after being impregnated with cooking liquor in an impregnation vessel, or impregnated with said cooking liquor in the digester. Although a continous vertical down flow digester is shown in FIG. 1, other digesters may be used such as inclined tube or horizontal tube digesters or the batch digester described with reference to FIG. 4 herein below.

In the digester 1, the wood chips are cooked beyond the defibration point generally at a temperature up to about 185° C. and at pressures of between about 5 to about 25 atmospheres. The continuous digester is preferably equipped with a high-heat (hi-heat) diffusion washing zone located in the lower portion of the digester as is known from the KAMYR continuous cooking system.

As mentioned above, the wood chips are cooked in the digester beyond their defibration point which, of course, depends on the type of wood or wood species, the pH, the temperature, the pressure and the alkali charge and is, in general, defined as the yield or kappa number after disintegration by a standard defibration treatment. In the method of the present invention the wood chips are cooked to a kappa number of 50 and below and preferably to a kappa number of 40 and below which is generally referred to herein as low kappa number pulp or low kappa number fibrous material. In the digester, the wood chips have been cooked and the lignin dissolved to such an extent that the low kappa number fibrous material is softened and the fibers are loosened although the fibrous material is still in the form of chips. In other words, and according to FIG. 2, the lignin bonding the fibers to each other has been dissolved, i.e., the chemical bonds between the fibers have been loosened, and the chips are kept together only by physical forces like cohesion. In contrast, fibrous material having a kappa number of above 50, such a high lignin or high yield pulps, that is, pulps of high lignin content such as, for example, linerboard hard stock requires mechanical disintegration at about 3–4% consistency after the chips have been cooked, as the lignin bonding the fibers together has not been dissolved so that there still exists a substantial amount of chemical bonds between individual fibers. In high-yield kraft systems, for example, the wood chips after cooking in the digester are not yet softened but are hard, chip-like particles which must be further disintegrated by refining preferably in the line between the digester and the blow tank. Mechanical refining is usually performed by blowing the pulp from the digester into disk refiners which have a power requirement of about 66 kWh (3.7 hpd) per ton. Higher disk speeds develop a better quality pulp. Single disk and double disk refiners generally operate at 1500 rpm and the energy applied during refining usually generates heat due to the friction between the fibers. Thus, a temperature gradient of about 30° C. and more is usually found to exist across the surface of disk refiners. As mentioned above, the major disadvantages of mechanical refining include enormous consumption of energy, additional material cost, and the fact that further cleavage or diminution of the fibers occurs and cannot be controlled. In addition, contaminants, such as knots have a kappa number of about 100 and cannot be bleached irrespective of the size thereof. If, however, the pulp cooked to a low kappa number has been mechanically refined by one or more grinding disks to break the digested chips, the knots have also been refined into small particles which renders a removal thereof extremely difficult or outright impossible. Thus, dark colored particles stemming from the knots will appear in the paper and diminish the quality thereof.

The low kappa number pulp utilized in the method of the present invention, still in form of wood chips with the physical bonds between the fibers essentially undisturbed is thus removed from digester 1 through line 2 at about the same or lowered temperature and pressure which prevailed in the digester. The softened wood chips containing loosened fibers are thereafter subjected to a shear force field of sufficient strength to substantially and completely separate the fibers from each other i.e. by breaking the physical cohesion forces. This shear force field is preferably generated by a rotor rotating at a rotational speed of about 500 to about 3000 rpm and, preferably, from about 1000 to about 2000 rpm, whereby the energy consumption of the rotating rotor is preferably between about 1 and 5 MJ/t of defiberized cellulosic material. It is extremely important that the volume of the housing in which the rotor is running is as small as possible. When calculated per volume, i.e. expressed in liter of apparatus volume, the energy consumption is from 0.1 to 15, and, preferably, from 5 to 10 kW/l. The consistency of the pulp is preferably between about 6 and about 15%. In accordance with a preferred embodiment, the energy consumption per liter of apparatus volume is about 0.25 to 1.25 MJ/t/l and more preferably from 0.40 to 0.85 MJ/t/l.

A preferred apparatus for performing the method of the present invention is the medium consistency mixer (AHLMIX, manufactured and distributed by the assignee A. Ahlstrom Corporation.) The apparatus is also described in U.S. application Ser. No. 07/738,815 filed Aug. 1, 1991, the entire disclosure of which is hereby incorporated herein by reference. The rotating rotor of the apparatus which is formed by a shaft and at least two finger-like blades generates a zone of fluidization of sufficient strength so as to separate the particles from each other and to form a fiber suspension which behaves like a liquid. This phenomenon, of course, is reversible and ceases practically entirely and immediately as soon as the pulp leaves the shear force field or fluidization zone. Preferably, the inside diameter of the apparatus for defiberizing the fiber accumulations is less than 1.5 times the inside diameter of the conduit of flow piping leading into the apparatus. The rotating rotor including a shaft and at least two finger-like blades defines an envelope surface the diameter of which is substantially equal to the diameter of the conduit through which the fiber accumulations are passed into the treatment apparatus. As it is also described in the above-referenced patent application, the shaft of the rotating rotor during the defiberizing process is preferably arranged transverse to the direction of flow of the fiber accumulations through the apparatus.

The pulp which has been defiberized and fluidized by the action of the shear force field is transferred from mixer 3 and introduced into a pressure diffuser 4 wherein soluble substances including lignin are removed by displacement. Of course, washing by dilution followed by thickening could also be utilized. From the pressure diffuser 4 the pulp may, depending on the kappa number to which the chips are cooked in the digester, be transferred through a second blow line 5 to a second device 6 containing a rotating rotor for the generation of a second shear force field substantially as that described above. Thereafter, the pulp is introduced into the atmospheric diffuser 7 containing a top mounted continuous diffuser washer for further displacing soluble substances and cooking liquor. Displacement or diffusion washers, particularly a single-stage diffuser on top of a high density storage tower has been developed by KAMYR. Multiple stages diffusers can, of course, also be used. After the diffusion washing, the pulp is transferred to the screening plant 8 including thickener 9.

The advantages gained by the method of the present invention include but are not limited to:

- a marked improvement of the drivability of the pressure diffuser 4;
- a considerable increase of the pulp consistency to a level of between about 10 and 15% for the operation of the pressure diffuser 4 and accompanying improvement in operation of the atmospheric diffuser 7;
- substantial savings in bleaching chemicals due to better washing efficiency, as shown in the following.

The degree of fiberization according to the method of the present invention has been measured with and without the operation of the devices for generating the shear force field in the following positions: M1 before the pressure diffuser 4; M2 after the pressure diffuser 4; M3 before the screening plant 8; and M4 after the thickener 9 of the screening plant 8.

Test results show that the degree of fiberization in the pressure diffuser 4 has increased from a level of 86–87% to a level of 90–95%. Also, the degree of fiberization of the pulp entering the screening plant 8 has been considerably improved. The tendency of "channelling", i.e., the tendency to form separate channels within the pulp in which the washing liquor is guided is decreased by the increase of the degree of fiberization or the homogeneity of the pulp. The diffusion process and thus the displacement efficiency of the process is increased, as there are no more channels along which the washing liquor could flow through the pulp layer substantially without washing the pulp at all. Also, the diffusion distance has been decreased, and the washing efficiencies have been drastically improved throughout subsequent equipment.

The washing losses which are usually defined in terms of the sodium content of the washed pulp leaving the final washing stage, expressed as kilograms (or pounds) of salt cake ($Na_2SO_4$) per ton of pulp have decreased as follows: At M1, in the pulp exiting from the digester 1 equipped with hi-heat diffusion washing, the washing losses have decreased from 200 kg down to 120 kg $Na_2SO_4$/tn. At M2, in the pulp exiting from the pressure diffuser 4, the washing losses decreased from 130 kg down to 70 kg $Na_2SO_4$/tn. At M3, in the pulp exiting from the one-stage atmospheric diffuser 7, the washing losses decreased from 40 kg down to 30 kg $Na_2SO_4$/tn; and at M4, in the pulp exiting from the screening filters 8 and 9, the washing losses decreased from 13 kg to 7 kg $Na_2SO_4$/tn.

A decrease of the washing losses of 5–10 kg of dry solids corresponds to a savings in bleaching chemicals, e.g. chlorine, of 7–15 kg. Additionally, the method of the present invention results in considerable savings of alkali. Due to the method of the present invention the displacement ratio (DR) of the pressure diffuser 4 which ratio defines the effectiveness of the pressure diffuser 4 in removing solids from the pulp and which is defined as the ratio of the actual reduction in soluble solids in the pressure diffuser compared to the maximum possible reduction, has increased from 0.9 to 0.95. The stick content (pin chips and knots) of the washed pulp has remained substantially the same, whereby the mixer used has not broken the knots in to high kappa number sticks.

According to a preferred embodiment of the present invention, chemicals such as white liquor may be introduced into the device for aiding the generation of the shear force field.

Figure 2:
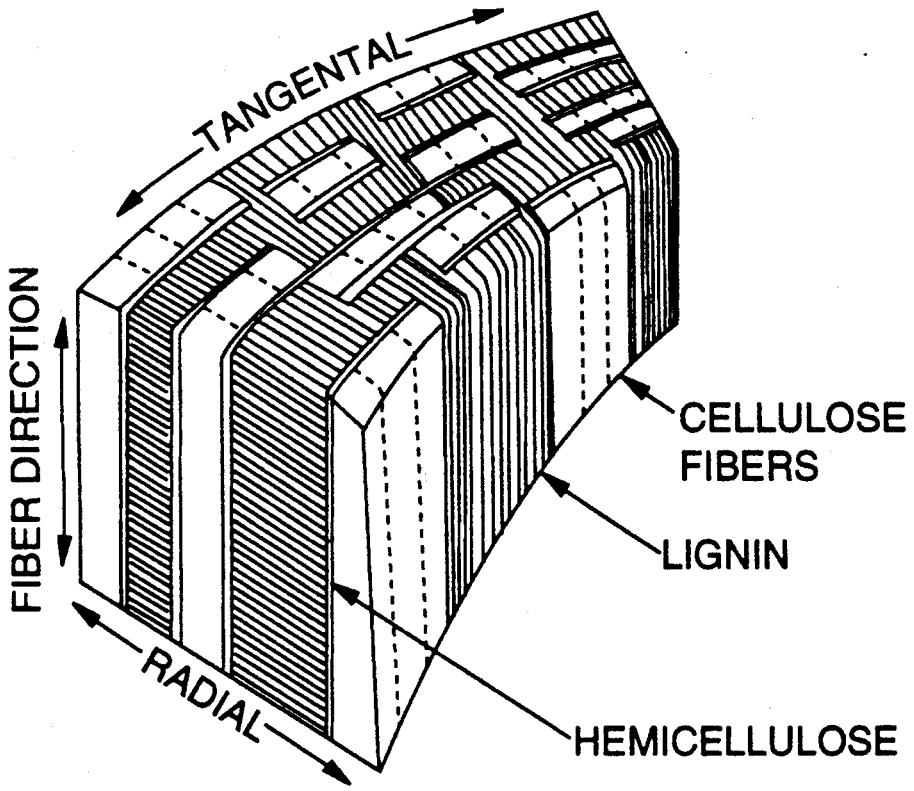
FIG. 2 is a schematic illustration of the structure of a wood chip.

FIG. 2 is a schematic illustration of the structure of a wood chip showing a number of cellulose fibers bound together by covalent bonds between the large molecular size lignin and the carbohydrate components of the fibers. As pointed out above, it is a characteritic of the present invention that the fiber accumulations are first treated in a treatment apparatus so as to break the chemical covalent bonds between the individual fibers and to leave the bonds caused by physical forces such as cohesion, between the fibers, essentially undisturbed. The fiber accumulations which have thus been pretreated are thereafter removed from the treatment apparatus and defiberized by subjecting the material to a sufficiently strong shear force field as described herein.

Figure 3:
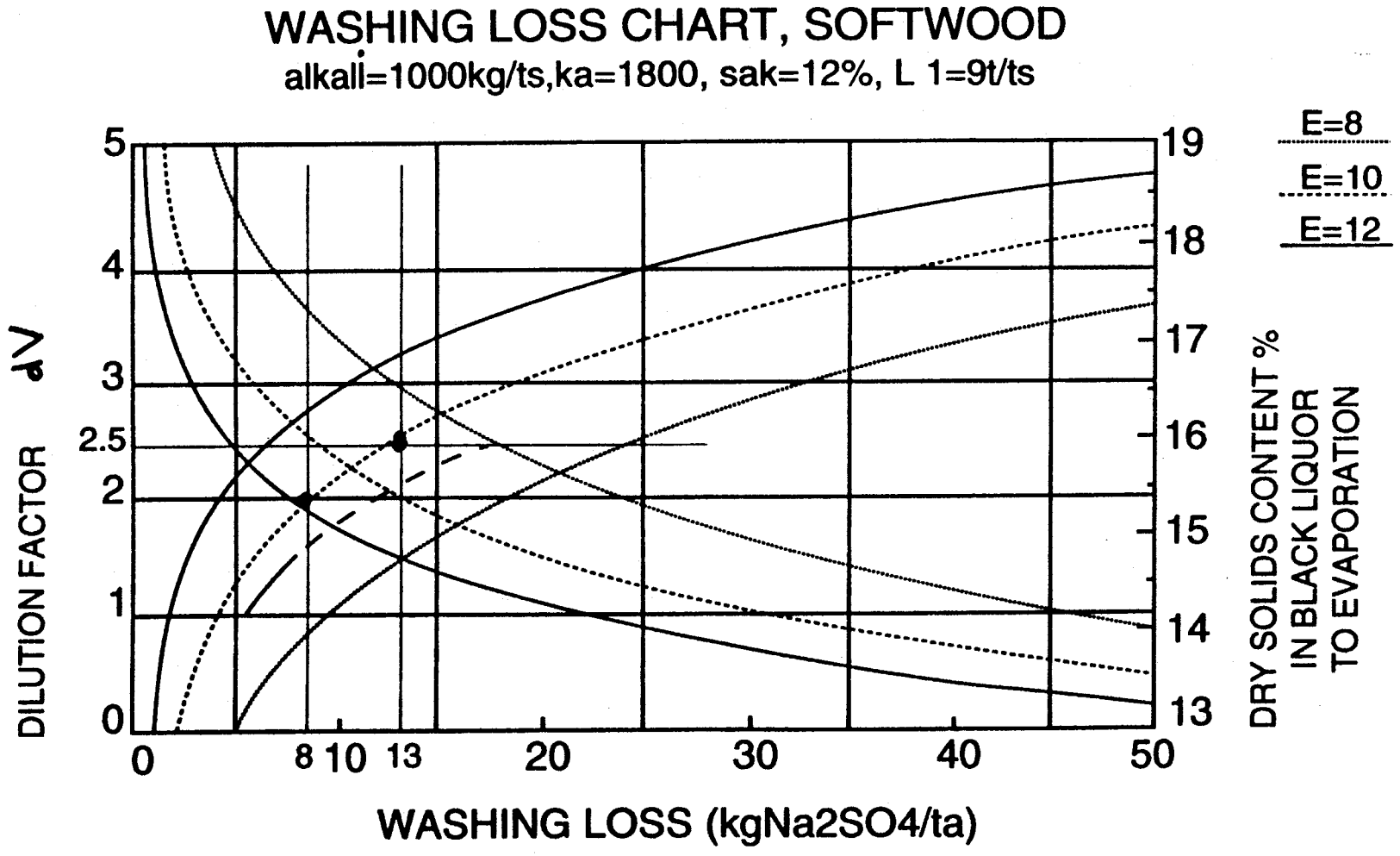
FIG. 3 is a graph for determining the efficiency factor of the digestion.

FIG. 3 illustrates the effect of the improvement of the present invention in washing efficiency on the operation of the entire process. The efficiency of the washing plant and the washing equipment is, in general, characterized by the efficiency factor E of Norden. The efficiency factor is often based on a consistency level of 12%, as was also done in the example.

In accordance with the example the washing loss level of the entire washing plant has been approximately 13 kg $Na_2SO_4$/tn with a dilution factor 2.5. The dilution factor represents $dV = V1 - V2$, in which V1 is the amount of washing liquid in $m^3$/tn and V2 is the amount of liquid discharged from the washing plant with the washed pulp in $m^3$/tn. As can be seen from FIG. 3, the efficiency factor of the entire washing plant has been of the order of 9, whereby the solids content of the black liquor introduced into the evaporators has been of the order of 15.5%.

After the improvement in accordance with the present invention the washing losses have decreased to 8 kg $Na_2SO_4$/tn, whereby the overall efficiency factor has increased up to a level of 12 taking into account that one has also been able to decrease the dilution factor. Correspondingly one has been able to feed stronger black liquor to the evaporators the solids content being 16.5%. This study has been performed by using the amount of $Na_2SO_4$ as the characterizing quantity. A similar study may be performed based on using COD or other appropriate basis.

As is shown, large savings and environmental advantages are to be gained when the solids are washed and recovered more efficiently and when the solids content of the black liquor can also be simultaneously increased. According to the example, savings of active chlorine of about 7–15 kg/tn, representing as much as 10–20% of the entire consumption, are achieved while the need of evaporation decreases as much as 10%. Mill scale studies have also shown that the washing of soft soap has improved. This has resulted in a decrease of the use of anti-foaming agents or foam inhibitors by about 30% which translates into significant savings and leads to an improved driveability of the equipment.

Based on the above study of the washing losses, substantial cost savings are obtained by locating the oxygen delignification stage between the existing washing stages. This can be done as long as the solids level (COD or the like) is not so high that it would have a negative effect on the oxygen delignification reaction. As is shown in the example, such an arrangement is possible in accordance with the present invention.

Figure 4:
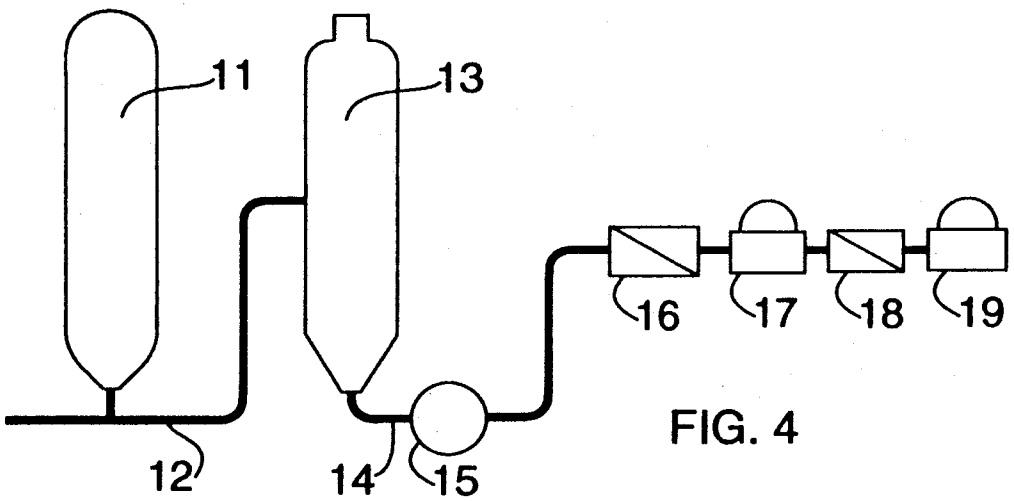
FIG. 4 is a schematic illustration of a fiber line including a batch digester.

Referring now to FIG. 4, numeral 11 indicates one of the digesting towers in a batch digester system which, for example, is used in kraft mills and comprises generally a number of vertical, generally cylindrical towers to insure the desired level of production. Wood chips and cooking liquor are introduced into the batch digester 11 and the fibrous material is cooked for about 30–120 min. at a pressure of about 5 to 25 bar and a temperature of about up to 185° C. From the batch digester 11 the pulp is then introduced via line 12 to a blow tank 13 from which the pulp is discharged into a blow line 14 and subjected to a shear force field by the oepration of e.g. the AHLMIX mixer 15 prior to introduction into knotter 16, washer 17, screen 18 and thickener 19.

In prior art batch digesting the pulp exiting from the digester is still in form of wood chips which causes problems in the knotter 16, as otherwise acceptable fibers will be separated into the rejects portion. Due to the method of the present invention the chips exiting from the digester and, specifically from blow tank 13, are substantially completely defiberized by means of a complete fluidization in a very gentle manner by completely delaminating the fibers without chopping or breaking the fibers into smaller pieces. Possible knots and other hard wood particles are not broken, but remain in their original form and size so that they are easily separated in the knotter.

The method of the present invention is applicable to prior art cold blow digesters in which the digester is filled with wood chips and substantially cold cooking liquor is thereafter added. The cooking liquor is circulated through a steam heated heat exchanger thereby raising the temperature of the cooking liquor and digester contents up to 185° C. whereby the pressure rises to about 9 bar. After the chips have reached the desired defibration point or level of digesting, for instance, the kappa number has been decreased down to 50 and preferably 40, a valve (not shown) at the bottom of the digester 11 is opened and the digester is permitted to empty out by its own pressure. The method of the present invention is equally applicable to RDH (Trademark of Beloit Corporation) or SUPERBATCH (Trademark of Sunds Defibrator) digesters in which hot cooking liquor is fed to the chips from the bottom of the digester. The hot cooking liquor is then circulated, with or without a heat exchanger, and steam is added to the liquor to raise the temperature thereof. After the desired defibration point is reached, the hot cooking liquor is displaced by warm liquor. The digested pulp is discharged from the RDH digester by blowing pressurized air into the top thereof, while the digested pulp is discharged from the SUPERBATCH digester by pumping.

Figure 5:
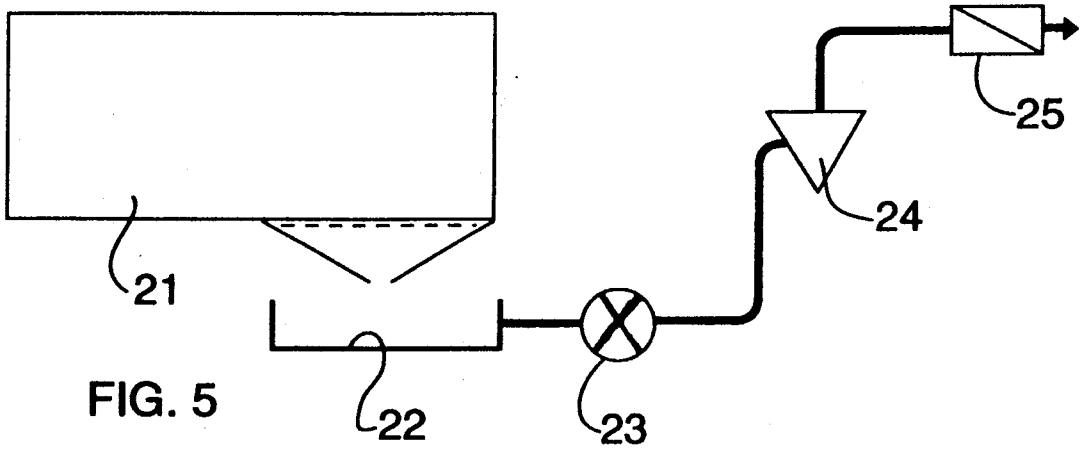
FIG. 5 is a schematic illustration of a recycled fiber process in accordance with the present invention.

FIG. 5 schematically illustrates the fiberization method of the present invention in a recycled or secondary fiber process. After the fiberizing drum 21 or a pulper, the recycled waste paper or paper board is generally in form of substantially large flocs of acceptable fibers which, nevertheless, frequently are rejected in the following cleaning stages. The flocs are kept together by substantially the same physical forces as the chips after digesting i.e. cohesion. As shown in FIG. 5, the recycled material containing large flocks is transferred from the defiberizing drum 21 into the vessel 22 through suitable perforations in known manner. By installing a device such as the AHLMIX 23 for generating a shear force field and for substantially completely defiberizing the recycled paper in the described manner, the pulp entering the cleaners 24 and screening apparatus 25 contains considerably less rejectable material thereby greatly improving the yield of the secondary pulping operation. Of course, if need be, chemicals may also be mixed into the pulp during the defibration operation.

Figure 6B:
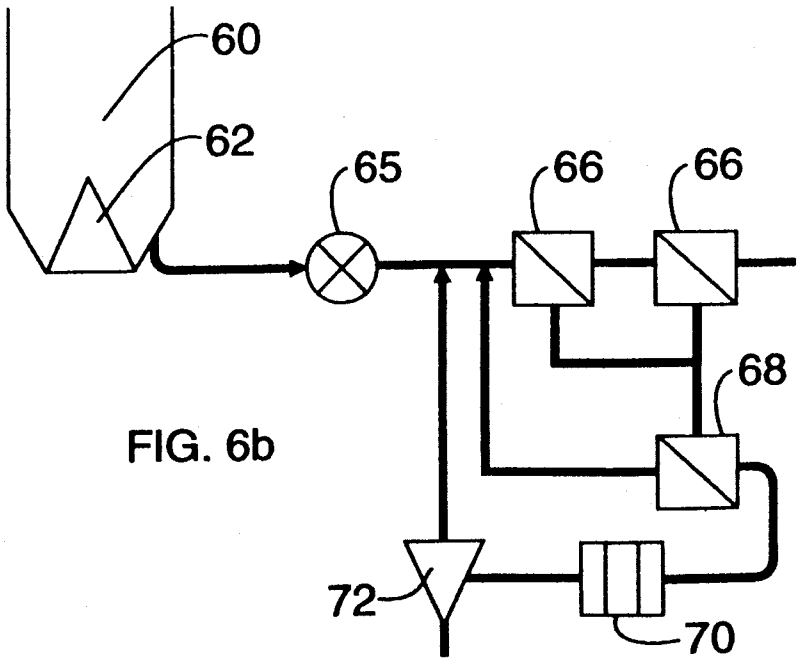
FIG. 6B is a schematic illustration of a broke system in accordance with a preferred embodiment of the present invention.
Figure 6A:
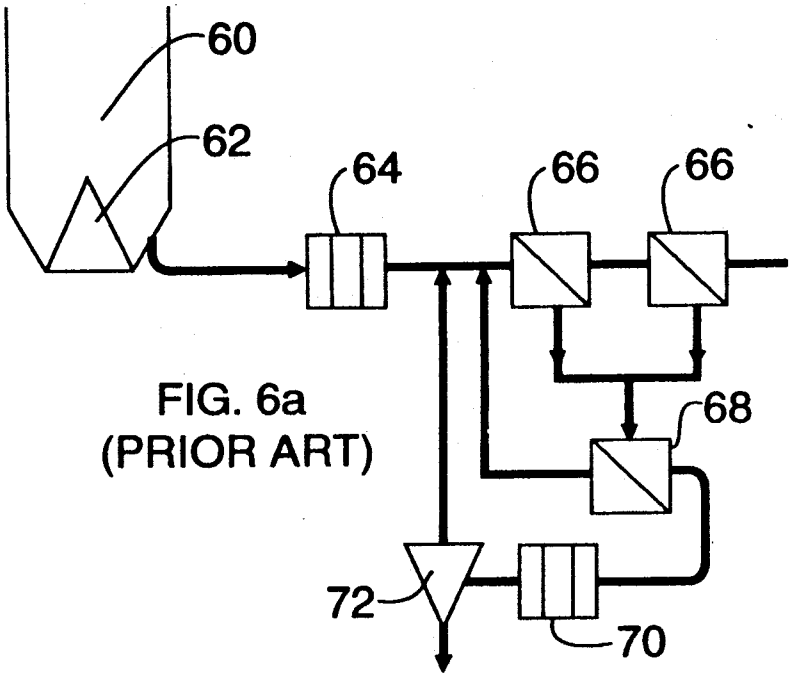
FIG. 6a (PRIOR ART)
FIG. 6A is a schematic illustration of a broke system in accordance with prior art.

FIG. 6A illustrates an exemplary broke system in accordance with the prior art. The broke is introduced into a pulper 60 in which the broke is pulped by means of a rotating rotor 62 for transforming the broke into a uniform fiber suspension. However, as is well known, a pulper is not able to perform a sufficient separation, so that the pulped suspension is passed from the pulper to a refiner 64 in which the fiber flocs still present in the pulp when leaving the pulper must be further refined mechanically. The treated suspension is thereafter introduced into a primary screening stage 66 including generally two screening apparatus in series. The reject from the primary screening stage 66 is introduced into a secondary screening stage 68. The accept portion of the secondary screening stage 68 is returned prior to the primary screening stage 66 and the reject fraction is introduced into a secondary refiner 70. Thereafter, the reject is again refined, divided into two fractions in a centrifugal separation stage 72 from where the accept fraction is returned prior to the two screening stages 66.

It is a clear disadvantage of the prior art broke treatment system that all of the broke particles are refined, as refiners are intended to be used in mechanical pulp production i.e. by grinding the wood chips to also separate chemically bonded fibers to form a fiber suspension. The use of a device intended for this relatively rough treatment results in a refining of the fiber material. In other words, the mechanical refining will result in a breaking of the fibers and a diminishing of the pulp quality.

FIG. 6B illustrates the broke system in accordance with the present invention. As can be seen, the fluidizing unit 65 has replaced the primary refiner 64 of FIG. 6A. Thus, the pulp discharged from the pulper 60, or from the defiberizing drum, flows into the fluidizing unit 65 to be fluidized completely, whereby in practice all the fiber material is fluidized and forms a substantially uniform fiber suspension. Only a small fraction of the pulped broke is, after the fluidizing unit, in floc-like accumulations that it has to be screened away from the main stream and introduced into a refiner 70 to be refined into smaller particles. Although a refiner is also shown in this embodiment, it is to be noted that only a very small fraction of broke is refined, in stark contrast to the prior art example where the entire broke had to be refined. The resulting advantage is that the recycled pulp is of remarkably higher quality, as it contains very little deteriorated or ground fibers.

Naturally, there are a number of different types of broke treatment arrangements used in pulp mills today. However, the arrangement in accordance with the present invention can be used in all of the different prior art systems to render the recovery of the fibers as efficient and gentle as possible. We have now found that by utilizing the fluidization method for separating the fibers from the fiber flocs by loosening the relatively weak physical forces which keep the fibers together, it is possible to aid the operation of a pulper or a defiberizing drum without any need for additional treatment of the pulped material in mechanical refiners. As the fluidization process includes the separation of fibers substantially without any physical contact with the fluidizing element the fractionation or diminution of the fibers as it occurs in prior art refines is minimized by the method of the present invention.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, however, therefore, to be limited only as indicated by the scope of the claims appended hereto.

What is claimed is:

1. A method of defiberizing fibrous cellulosic material bound by chemical bonds and physical force, comprising:

(1) treating the fiberous cellulosic material in a treatment apparatus so as to loosen the chemical bonds between the fibers but to leave the bonds caused by physical force essentially undisturbed to generate treated fiber accumulations;

(2) removing a stream of said treated fiber accumulations from said treatment apparatus;

(3) defiberizing said treated fiber accumulations by subjecting the material to shear forces in the stream, said shear forces being of sufficient strength to substantially break the physical forces keeping the fibers together and to separate said fibers without breaking knots or shives into smaller particles.

2. The method according to claim 1, wherein step (1) is performed by (a) introducing the fibrous material in form of wood chips into a digester; and (b) by chemically treating the wood chips in the digester at a pressure and a cooking temperature beyond the defibration point of the fiberous material so as to soften the wood chips and to loosen the fibers;

step (2) is performed by (c) removing a stream of the treated wood chips from the digester; and step (3) is performed by (d) defiberizing the treated wood chips by generating shear forces in the stream, said shear forces being of sufficient strength to substantially separate the fibers and by subjecting the wood chips to the shear forces.

3. The method according to claim 2, wherein said defiberizing step (d) is performed at a temperature of from 70° to 185° C.

4. The method according to claim 2, wherein said defiberizing step (d) is performed at a pressure within the range of from about 1 to about 25 bar.

5. The method according to claim 2, wherein the fibrous material is treated in the digester to a kappa number of up to 50.

6. The method according to claim 2, wherein the fiberous material is treated in the digester to a kappa number of 40 and below.

7. The method according to claim 2, wherein the fiberous material is treated in the digester to a total pulp yield of below about 50%.

8. The method according to claim 2, wherein said defiberizing step (d) is performed at a consistency of about 6% to about 15%.

9. The method of claim 2, wherein the digester is a batch digester.

10. The method of claim 2, wherein the digester is a continuous digester.

11. The method according to claim 1, wherein the shear forces are generated by rotating a rotor so as to establish a shear force field extending into the stream of fiber accumulations thereby effecting said defibration step (d).

12. The method according to claim 11, wherein said rotor is rotated at speeds ranging from about 500 to about 3000 rpm.

13. The method according to claim 11, wherein the rotor is rotated at speeds of from about 1000 to about 2000 rpm.

14. The method according to claim 11, wherein the energy consumption of the rotating rotor is between about 1 and about 5 MJ per ton of defiberized cellulosic material.

15. The method according to claim 11, wherein the energy consumption of the rotating rotor is between about 0.1 and about 10 MJ per ton of defiberized cellulosic material per liter of the apparatus volume.

16. The method according to claim 1, wherein step (3) is practiced by passing the fiber accumulations in a direction of flow through a conduit having a diameter of flow through a conduit having a diameter into an apparatus for generating the shear forces and having an inside diameter of less than 1.5 times the diameter of the conduit leading into the apparatus.

17. The method according to claim 16, wherein the defiberizing step is performed with an apparatus having a rotor including a shaft and at least two finger-like blades, the diameter of the envelope surface defined by the rotating blades being substantially equal to the diameter of the conduit.

18. The method according to claim 17, wherein the defiberizing step is performed by arranging the shaft transverse to the direction of flow of the fiber accumulations.

19. The method according to claim 1, further comprising the steps of washing the fibrous material in washing stages; and performing an oxygen delignification between said washing stages.

20. The method according to claim 1, wherein step (1) is performed in a pulper for breaking the chemical bonds between the fibers of recycled paper or broke.

21. The method according to claim 1, wherein step (1) is performed in a defiberizing drum for breaking the chemical bonds between the fibers of recycled paper or broke.

22. The method according to claim 1, wherein step (1) is performed by (a) introducing the fibrous material in form of recycled paper or card board material into a pulper and (b) feeding a liquid into the pulper to dilute the material and treating the material in the pulper by mechanically agitating the material to soften the material and to loosen the fibers;

step (2) is performed by (c) removing a stream of the treated material from the pulper; and step (3) is performed by (d) defiberizing the treated material by generating shear forces in the stream, the shear forces being of sufficient strength to substantially separate the fibers and to form a uniform fiber suspension.

23. The method according to claim 22, wherein the fibrous material in step (a) is introduced in form of recycled paper or card board material into a defiberizing drum.

* * * * *